US006210285B1

(12) United States Patent
Susko

(10) Patent No.: US 6,210,285 B1
(45) Date of Patent: Apr. 3, 2001

(54) BEACH SLING-JUMP AMUSEMENT DEVICE

(76) Inventor: Rudolf Susko, 176 Gariepy Cresent, Edmonton (CA), T6M 1A2

( * ) Notice: Subject to any disclaimer, the term of this patent is extended or adjusted under 35 U.S.C. 154(b) by 0 days.

(21) Appl. No.: 09/408,100

(22) Filed: Sep. 29, 1999

(30) Foreign Application Priority Data

Oct. 1, 1998 (CA) ..... 2247547

(51) Int. Cl.[7] ..... A63G 31/04
(52) U.S. Cl. ..... 472/50; 472/133
(58) Field of Search ..... 472/25, 49, 130, 472/137, 135, 129, 50, 133; 434/29, 30, 55; 124/16, 17, 21, 26

(56) References Cited

U.S. PATENT DOCUMENTS 3,066,951 * 12/1962 Gray ..... 472/25
3,460,828 * 8/1969 Curlee ..... 472/25
3,477,713 * 11/1969 Cudmore ..... 472/25
4,580,982 * 4/1986 Ruppert ..... 434/30
5,303,695 * 4/1994 Shopsowitz ..... 124/17
5,694,913 * 12/1997 Parrott ..... 124/17
5,769,724 * 6/1998 Wiegel ..... 472/49

* cited by examiner

*Primary Examiner*—Kien T. Nguyen

(57) ABSTRACT

A beach sling-jump amusement device for ejecting occupants into the air, featuring a pair of bows intersected by a brace secured on a support frame. An ejection seat having portions defining a trampoline for receiving an occupant. The trampoline is supported centrally in place by drawstrings laced to the bow arching arms. Unlike a conventional bow, the drawstrings with the seat are retracted to a drawn position in opposite direction toward the bow arch, enabling unobstructed ejection of an occupant into a free-flight and safe landing in water. The seat is retracted into a ready position by a winch mounted on the frame. An optional projectile capsule is provided, which is essentially a hollow ball made from a resilient material having a receiving cavity for an occupant. The capsule, adapted and sized for accommodating an occupant, is loosely positioned on the trampoline ring.

7 Claims, 3 Drawing Sheets

BEACH SLING-JUMP AMUSEMENT DEVICE

CROSS-REFERENCE TO RELATED APPLICATION

Application No.: 2,247,547 in Canada
Specification filed: Oct. 1, 1998 in Canada.
Status: Application completion deadline Jan. 1, 2000 (In accordance with the Canadian Patent Law).

BACKGROUND OF THE INVENTION

Present invention relates to the general class of amusement devices or more specifically to a mechanism for catapulting or ejecting. Its use will be in ejecting projectiles into the air and landing in water, with particular application for water front recreational activities wherein projectile means people.

Prior art, relating to this category of devices for ejecting or launching humans into the air, has a long history. U.S. Pat. No. 562,448 was issued in 1896. The document shows a device for projecting an acrobat like an arrow. The device uses a board for supporting and sliding the person on to be launched. Utility of this device is mostly for acrobats requiring skill and physical strength.

U.S. Pat. No. 4,431,182 also claims a mechanism for launching an occupant by means of a pneumatic actuator. The device is quite elaborate and mechanically complex for easy assembly and transport for waterfront activities.

U.S. Pat. No. 5,303,695 is another example of a launching device. Like all devices, in this category and utility, have inherent safety problems and challenges. This device is projecting an occupant through a triangular opening that is not a safe passage for a human projectile. Furthermore, an elastic cord tensioned as shown, can easy cause injury to an occupant. The trajectory angle of a triangular structure is quite flat at 30 degrees.

U.S. Pat. No. 5,421,783 is essentially a huge bungee jumping equipment in which passengers are confined in a seat which is bouncing up and down after launching. This is not a free-flight launching apparatus for waterfront activities.

U.S. Pat. No. 5,769,724 describes a catapult device. This device which includes a parachute landing is not readily adapted to waterfront activities and uses. The mechanism featuring a parachute for safe landing of the catapulted objects, and elaborate separation of a rider from a pod.

The use of present invention on water fronts has not been documented to date. Most recreational activities offered on public beaches and other waterfront places are instantly disseminated throughout the world. Waterfront rides of a similar nature are presently limited primarily to parasailing. Moreover, more members of the public are exhibiting a desire to experience the sensation of free-flight and diving in water. The present invention of free-flight launching and water landing device, was designed with the consideration for safety. It provides, as it will be apparent from the specification, an unobstructed and safe launching configuration and safe landing in water, with an optional detached capsule.

SUMMARY OF THE INVENTION

It is the objective of the present invention to provide an additional dimension to water diving as a recreational pastime and sport It is the further objective of the invention to satisfy the appetite of the fun-loving public on many water fronts with an alternative activity and excitement. The present invention is constructed for rapid successive rides and is quite portable and easily assembled.

Additional activities, such as acrobatic free-flight or landing into the inflatable landing cushions, can evolve from the use of the present invention. It also enhances the practice of trampoline-like activities.

The present invention consists of a projectile ejecting equipment relying on manual drawing power and therefore, its outdoor use is not limited by location. In one aspect of the invention the equipment comprising a support frame having a tensing means secured thereto. A propelling means provided by a pair of resilient bows. The bows are secured in a brace on the frame intersected at the middle of an arch, and are disposed diverging outward. The brace is pivotally secured to the frame for changing the angle of trajectory. An ejection seat for receiving an occupant to be elected is centrally suspended by the intersecting arching bows. A fastener, defining a drawstring, connects the seat to the opposing ends of the bows. The seat is essentially a trampoline structure, wherein a flexible mat secured at the center of a ring is used for placement of an occupant. Alternatively, an occupant is placed in an optional detached capsule defining a hollow airtight ball, having a body cavity for accommodating an occupant therein. By engaging the tensing means the seat is drawn toward the bow arches to a ready position—opposite direction of a conventional bow. The tensing means cable is connected to the seat by an interlocking release means. Upon releasing the seat, the tensile bows are capable of recovering original positions and thrusting the seat in an inclined path, whereby an occupant placed therein is ejected into a free-flight.

BRIEF DESCRIPTION OF THE DRAWINGS

The invention, as exemplified by a preferred embodiment, is described with reference to the drawings in which.

DESCRIPTION OF THE PREFERRED EMBODIMENTS

Figure 1:
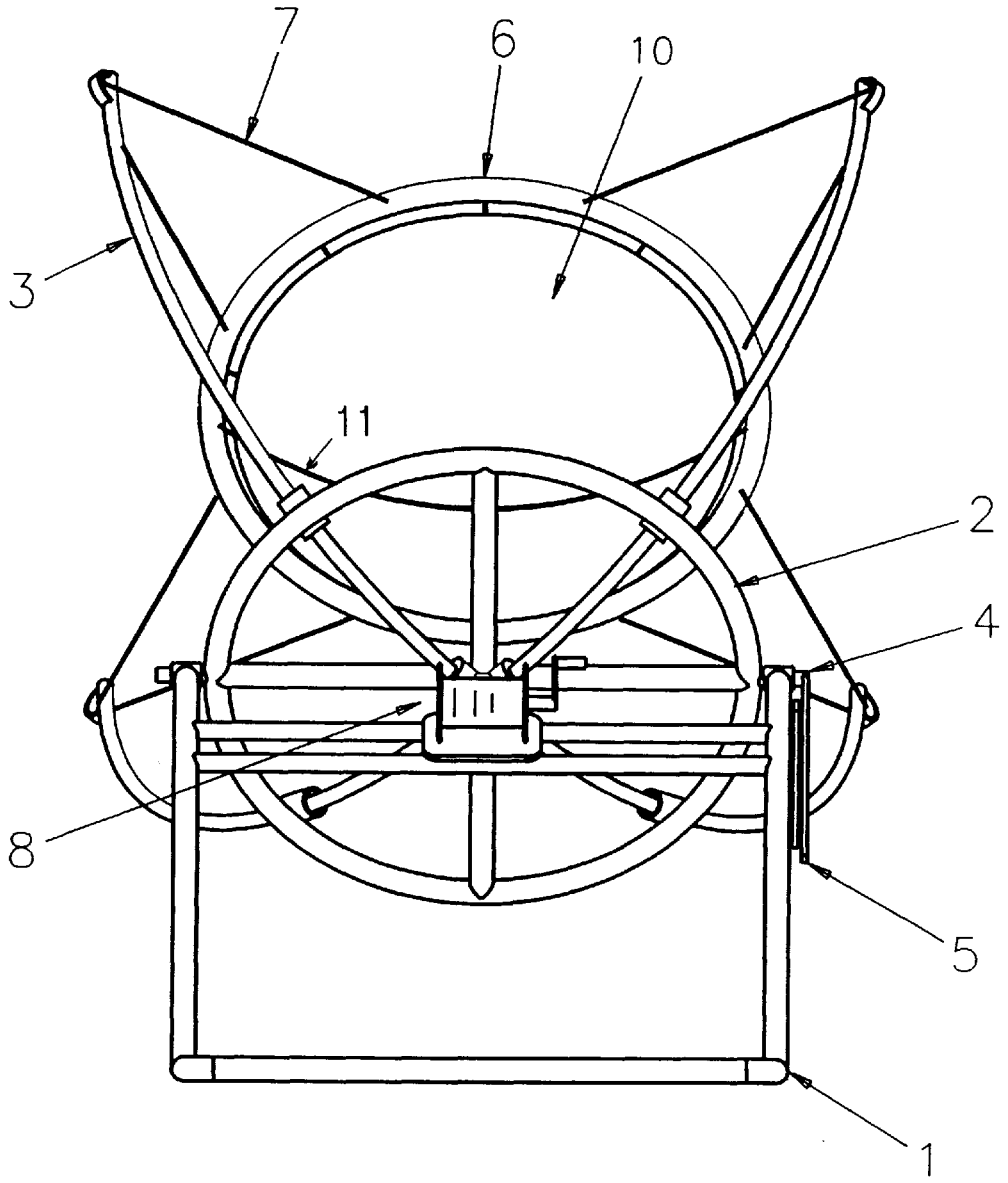
FIG. 1 is a rear view of the sling-jump recreational equipment illustrating the invention.
Figure 2:
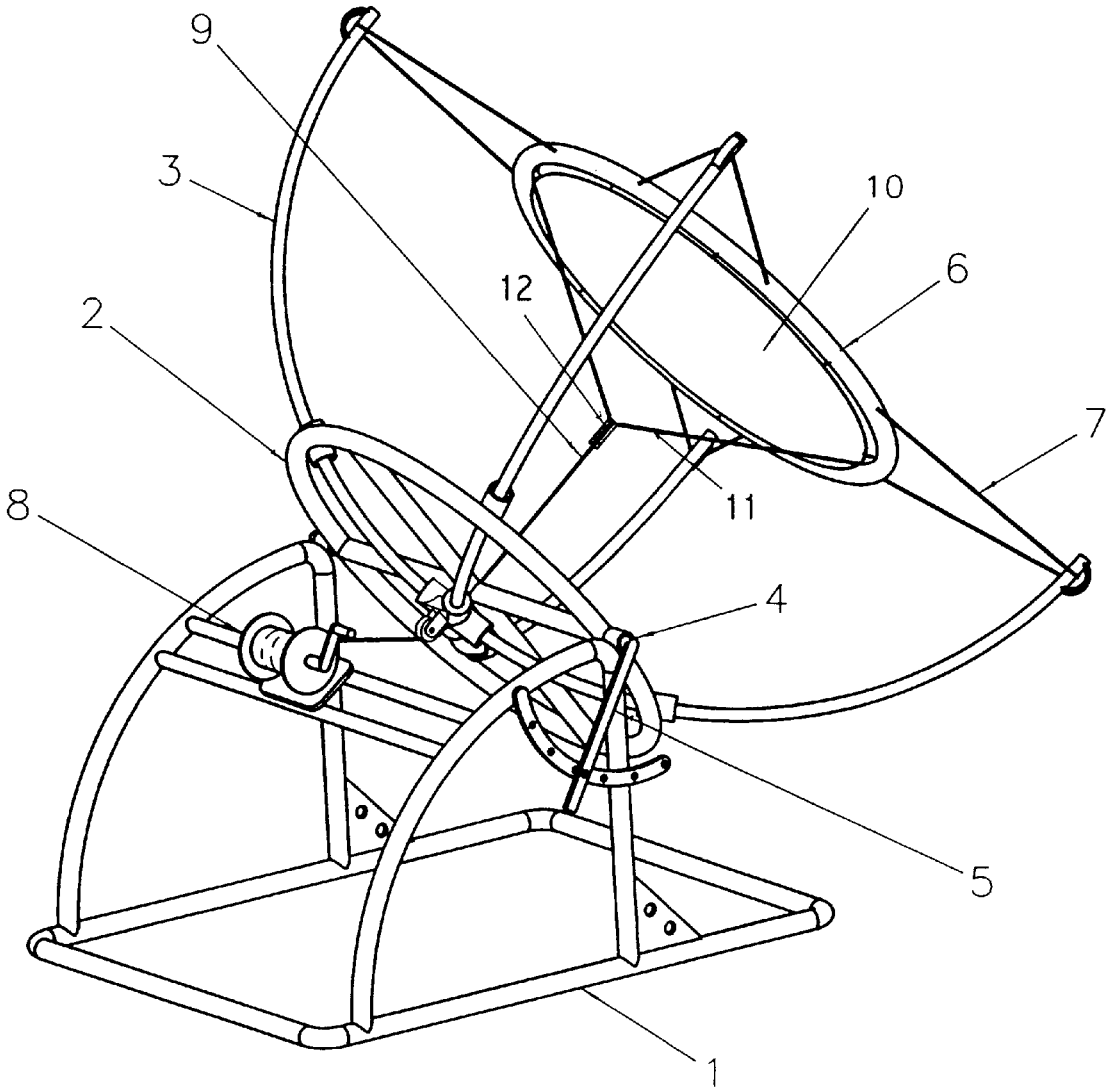
FIG. 2 is a side view of the same embodiment.
Figure 3:
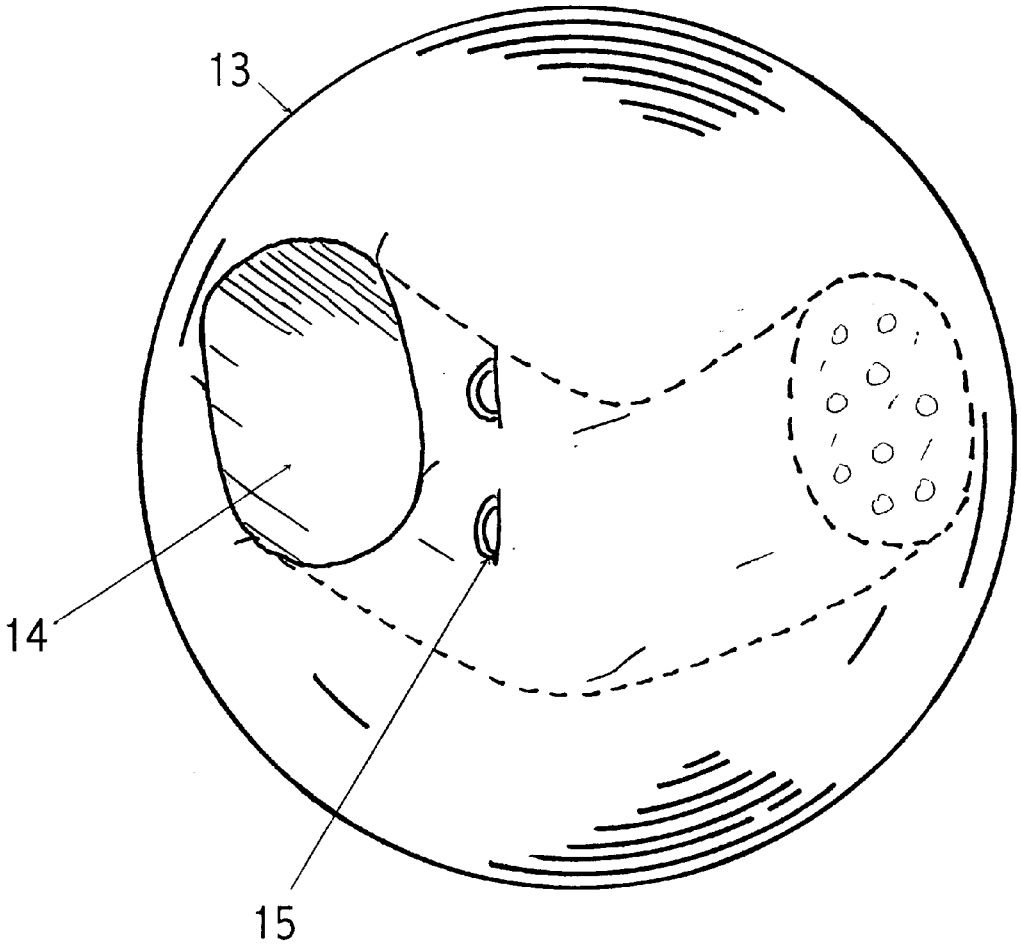
FIG. 3 is a perspective view of the projectile capsule.

Referring to drawings, the embodiment of the invention shows a support frame 1 made from a tubular metal material bent to form a desired support. The frame includes a brace 2, made from the same tubular metal material. The brace is pivotally 4 connected to the frame and secured in an adjustable position by a rod 5 so that inclined path of ejection can be changed. An ideal angle for parabolic trajectory is 45 degrees with the horizontal plane. Four resilient poles, similar to vaulting poles, secured in the brace at one end form a pair of bows 3 intersected at arches in the brace. The poles are anchored detachably, for transport disassembly, in the brace by being slid in X-shaped sleeve fittings as shown in FIG. 2, and secured therein by a threaded bolt or other tube in tube fastening fashion. An ejection seat 6 is secured to each pole distal end from the frame by a fastener 7, defining a non-stretchable cord, by which the poles are being bent inwardly, forming two intersecting bows. By this arrangement the seat is suspended centrally by tensing drawstrings in an initial resting position. Ejection seat is essentially a trampoline made from a light, preferably aluminum tubing material adapted and sized to accommodate an occupant. In a transverse axis of the trampoline ring a concave support 11, made from solid metal material, is secured for connecting a draw cable 9 thereto. As is readily apparent, the seat is a receptacle provided with a flexible mat 10 secured in the center of the ring. The resilient center mat absorbs the impact of the seat acceleration while enhancing the ejecting force. The ready or pre-launch position is produced by a tensing means 8, for instance, a hand-powered winch which is mounted on a support frame as is readily apparent. Winch cable, interlocking the winch with the seat support, features a release means 12. The release means is defining as common spring latch provided with a string release or any other cable lock/release mechanism readily available.

An alternative mode of accommodating an occupant to be ejected, is provided by a projectile capsule 13. The flexible mat is removed from the seat center for this mode of ejection. The capsule is essentially a detached airtight beach ball made preferably from a transparent vinyl or similar resilient material. It has an oval elongated tubular cavity 14 which is V-shaped through its body. The cavity is adapted and sized for an easy entry and exit of an average person with the help of two grip handles 15, secured on the cavity wall. The configuration of the cavity is such that the occupant's weight disposition in the capsule will make the capsule turn face up after plunging in water. The occupant is held in a capsule during a free-flight by the grip handles. Capsule is loosely placed in the ejection seat ring which has a smaller diameter than the capsule so that it can hold a ball-like object, in a pre-launch position.

The ejecting of an occupant occurs when the winch cable 9 is hitched to the seat support 11 by the release latch 12. Engaged winch 8 draws the seat 6 toward the frame 1 to a ready pre-launch position whereby further arching resilient bows 3. In fact, some arrangement of resilient bows can provide a complete circle of arched bows. While in this position, an occupant is loosely positioned on the ejection seat mat 10, sitting or crouching on the back. Upon releasing the latch 12 by a latchstring the ejection seat 6 is accelerated by the forces of the resilient bows 3 recovering original position. This is similar to that of a conventional bow action except bows in the present device are retracted opposite direction towards the intersected arches. The seat 6 with an occupant is accelerated in an inclined forward path until the bows reach its original position. Created impetus causes an occupant to leave the seat 6 and continues parabolic free-flight path. The desirable distance traveled by the ejected person is produced by the combination of the trajectory angle and the bows 3 bending strength given by the force exerted on the bows by the drawing distance of the winch 8. Seat 6 drawing distance can be calibrated and marked on the winch cable 9 for various occupant weights. The capsule 13 is retrieved from the water by the occupant leaving the capsule using the grip handles 15, or optionally by a light string connected to the capsule.

Although only a single embodiment of the present invention has been described and illustrated, the present invention is not limited to the features of this embodiment, but includes all variations and modifications within the scope of the claims. For instance the configuration of the poles can be different. The poles can be arranged to propel an occupant positioned in the seat more like pole-vaulting whereby a pair of poles are anchored in the frame diverging forward therefrom and the propelling force is created by arching poles in a vertical plane.

The present device can easily be constructed by those skilled in the equipment manufacturing trade similar to that of fitness equipment. Present device can include ready made elements such as vaulting poles and trampoline mat.

The embodiments of the invention in which an exclusive property or privilege is claimed are defined as follows:

1. A device for ejecting projectiles comprising:

a support frame having a brace secured thereto;

an ejection seat for conveying a projectile having sufficient size to accommodate a human occupant;

a pair of resilient poles for propelling said seat, each said pole having two opposite ends, said poles having portions being stationary connected to said brace and each distal end extending outwardly from the stationary connection of each said pole having a connection for being tensed; and means for tensing said resilient poles being mounted on said frame having a cable and means for being detachably interlocked with said seat for drawing said seat towards said brace whereby arching said poles, upon releasing the cable from said seat said poles thrusting said seat in a predictable path with a projectile leaving said seat into a free-flight.

2. A device as defined in claim 1 further comprising a fastener for linking centrally positioned said seat to each distal end from the stationary connection of each said pole, said fastener having a basic length.

3. A device as defined in claim 1 wherein said ejection seat having portions defining a trampoline.

4. A device as defined in claim 1 wherein each said pole having substantially central portion secured stationary in said brace intersecting each other and each oppositely extending end of each said pole being arched upwardly forming a pair of bows, the bows having an inverse drawing direction to a conventional bow.

5. A device as defined in claim 1 wherein said tensing means is a manually operated winch.

6. A device as defined in claim 1 wherein said tensing means is a motorized winch.

7. A device for ejecting projectiles comprising:

a support frame having a brace secured thereto;

an ejection seat for conveying a projectile having sufficient size to accommodate a human, said seat having portions defining a trampoline;

a pair of resilient poles for propelling said seat, each said pole having two opposite ends, the configuration of said poles for providing a propulsive force being such that each said pole having portions being stationary connected in said brace and each distal end extending outwardly from the stationary connection of each said pole having a connection for being tensed;

a fastener for linking centrally positioned said seat to each distal end from the stationary connection of each said pole, said fastener having a basic length; and means for tensing said poles being mounted on said frame having a cable and means for being detachably interlocked with said seat;

wherein, engaged said tensing means drawing said seat towards said brace whereby tensing said poles, upon releasing the cable from said seat said poles thrusting said seat in a predictable path with a projectile leaving said seat into a free-flight.

* * * * *